US009976296B2

(12) United States Patent
Nish

(10) Patent No.: US 9,976,296 B2
(45) Date of Patent: May 22, 2018

(54) MODULAR DECK SYSTEM

(71) Applicant: Good Times Co. Pty Ltd, Cheltenham (AU)

(72) Inventor: Scott Nish, Cheltenham (AU)

(73) Assignee: Good Times Co. Pty Ltd, Cheltenham (AU)

( * ) Notice: Subject to any disclaimer, the term of this patent is extended or adjusted under 35 U.S.C. 154(b) by 0 days. days.

(21) Appl. No.: 15/100,184

(22) PCT Filed: Nov. 27, 2014

(86) PCT No.: PCT/AU2014/050382
§ 371 (c)(1),
(2) Date: May 27, 2016

(87) PCT Pub. No.: WO2015/077841
PCT Pub. Date: Jun. 4, 2015

(65) Prior Publication Data

US 2017/0022697 A1 Jan. 26, 2017

(30) Foreign Application Priority Data

Nov. 27, 2013 (AU) ..... 2013263734

(51) Int. Cl.
*E04B 1/00* (2006.01)
*E04F 15/02* (2006.01)
(Continued)

(52) U.S. Cl.
CPC ..... *E04B 1/003* (2013.01); *E04B 1/34326* (2013.01); *E04B 1/34331* (2013.01);
(Continued)

(58) Field of Classification Search
CPC .. E04B 1/34331; E04B 1/34326; E04B 1/003; E04F 15/0247; E04F 15/02044; E04F 2015/02061; E04F 15/02183
(Continued)

(56) References Cited

U.S. PATENT DOCUMENTS 1,045,219 A * 11/1912 Tramill ..... E04B 1/6116 52/299
2,115,824 A * 5/1938 McRorey ..... E04H 9/021 254/98
(Continued)

FOREIGN PATENT DOCUMENTS

| | | | |
|---|---|---|---|
| GB | 2 386 620 | A | 9/2003 |
| IE | 000990 | A2 | 10/2001 |
| WO | 2005/095732 | A1 | 10/2005 |

*Primary Examiner* — Brian E Glessner
*Assistant Examiner* — Adam G Barlow
(74) *Attorney, Agent, or Firm* — Seed IP Law Group LLP

(57) ABSTRACT

A modular deck system includes a plurality of base frames that each include four peripheral frame members that are to be fastened together into a rectangular box, and one or more internal frame members that each are to be secured within the box between opposing peripheral frame members. A plurality of frame legs that are each to be secured to one of the base frames to support the respective base frame above a ground surface. The plurality of base frames are fastened to one another to provide a support structure on which to secure deck material.

16 Claims, 15 Drawing Sheets

(51) Int. Cl.
*E04B 1/343* (2006.01)
*E04F 15/024* (2006.01)

(52) U.S. Cl.
CPC .... *E04B 1/34347* (2013.01); *E04F 15/02044* (2013.01); *E04F 15/0247* (2013.01); *E04F 15/02183* (2013.01); *E04F 2015/02061* (2013.01)

(58) Field of Classification Search
USPC ..... 52/126.6, 126.3, 126.4, 126.7, 263
See application file for complete search history.

(56) References Cited

U.S. PATENT DOCUMENTS 2,386,494 A * 10/1945 Nagle ..... E21B 15/00 52/118
2,949,984 A * 8/1960 Daniels ..... E04B 1/36 248/188.4
2,963,131 A * 12/1960 Brockway ..... E04B 2/7433 52/126.4
4,622,792 A * 11/1986 Betts ..... E04B 5/12 52/263
4,991,365 A * 2/1991 Jackson ..... A47B 91/024 160/135
5,313,756 A * 5/1994 Ways ..... E04B 1/003 404/35
5,323,563 A * 6/1994 Rogers ..... E04H 3/28 52/126.6
5,425,214 A * 6/1995 Truelove ..... E04B 5/02 52/126.1
5,516,069 A * 5/1996 Hanna ..... E02D 27/02 248/354.1
5,564,235 A * 10/1996 Butler ..... E02D 27/00 16/260
5,819,482 A * 10/1998 Belke ..... E04C 3/005 248/354.3
6,209,267 B1 * 4/2001 Dantzer ..... E04B 5/12 52/480
6,347,489 B1 * 2/2002 Marshall, Jr. ..... E02D 27/00 248/354.5
6,820,379 B1 * 11/2004 Krinner ..... E04H 12/2223 108/156
2005/0056760 A1 * 3/2005 Carlson ..... E04G 11/48 248/354.3
2005/0126096 A1 * 6/2005 Obenhaus ..... E04B 1/003 52/263
2007/0028533 A1 * 2/2007 Stroyer ..... E01D 2/00 52/126.6
2009/0071084 A1 * 3/2009 Johansson ..... E04F 15/02452 52/263
2010/0281790 A1 * 11/2010 Burgess ..... E04F 15/0247 52/126.6
2012/0090256 A1 * 4/2012 Andrews ..... E04F 15/02044 52/263

* cited by examiner

MODULAR DECK SYSTEM

BACKGROUND

Technical Field

The present invention relates to a modular deck system.

DETAILED DESCRIPTION

Decks are an architectural feature provided to domestic and commercial buildings to enhance the function and usability of outdoor spaces. Decks are constructed against external walls, such that the deck can be accessed through an external door. At least part of the deck surface can be raised above the natural ground surface to approximately the same level as the floor immediately inside the external door. Occupants of the building find the deck to be an appealing feature in that it provides an easy space in which to enjoy being outside, for example when dining, outdoor cooking, and entertaining guests.

The need to satisfy building codes and standards has historically resulted in decks being individually engineered constructions. Furthermore, the fact that each deck is unique increases the time and complexity of its construction. These factors result in substantial costs associated with deck construction.

It is desired to provide a deck system that simplifies deck construction, and/or can at least provide a useful alternative.

BRIEF SUMMARY

According to a first aspect of the present invention there is provided a modular deck system comprising:

a plurality of base frames that each include four peripheral frame members that are to be fastened together into a rectangular box, and one or more internal frame members that each are to be secured within the box between opposing peripheral frame members; and a plurality of frame legs that are each to be secured to one of the base frames to support the respective base frame above a ground surface, wherein the plurality of base frames are fastened to one another to provide a support structure on which to secure deck material.

In certain embodiments, the peripheral frame members are fastened together into the rectangular box, and the internal frame members are each secured within the box between opposing peripheral frame members to form a deck module; and the frame legs are each secured to one of the base frames to support the respective deck module above a ground surface;

wherein the base frames of the deck modules are fastened to one another to provide a support structure, and the modular deck system further comprises deck material that is secured to the support surface.

Preferably, each base frame includes two primary peripheral frame members, and two secondary peripheral frame members, wherein when the peripheral frame members are assembled into the rectangular box, end surfaces of the secondary peripheral frame members are secured against side surfaces of the primary peripheral frame members. In at least some embodiments, the primary peripheral frame members are longer than the secondary peripheral frame members. In certain embodiments, each base frame forms a square box.

In certain embodiments, each of the primary peripheral frame members has a first set of holes pre-drilled in a direction perpendicular to a side surface to facilitate location of fasteners to secure the primary peripheral frame members to the secondary peripheral frame members.

In some embodiments, each internal frame member extends between the two primary peripheral frame members, and each of the primary peripheral frame members has a second set of holes pre-drilled in a direction perpendicular to a side surface to facilitate location of fasteners to secure the internal frame members to the primary peripheral frame members.

Preferably, the frame legs comprise:

a body that has an internally threaded hole;

a foot that has a ground contacting member, and an externally threaded shank that is received in the internally threaded hole such that the separation of the ground contacting member and the body is selectively adjustable; and a support surface that provides vertical support to the base frame to which respective frame leg is secured.

The plurality of frame legs can include first frame legs in which the body is elongate with the internally threaded hole formed at a first end of the body, and the frame leg further comprises a head that is to be secured to a second end of the body, the head having a horizontal flange that forms the support surface, and one or more uprights that extend perpendicularly to the horizontal flange wherein peripheral frame members are secured to the uprights.

In some embodiments, the modular deck system includes at least two sets of frame leg bodies, the first set of frame leg bodies having a length that differs from the length of the bodies in the other set(s). More preferably, the modular deck system includes four sets of first frame leg bodies.

Preferably, the uprights project upwardly from the horizontal flange. More preferably, the head has two uprights that are orthogonal to one another.

Alternatively or additionally, each of the primary peripheral frame members can have at least one blind hole that opens onto a bottom surface of respective peripheral frame member, and the plurality of frame legs can include second frame legs in which the body has a cylindrical portion, and a flange formed at one end of the cylindrical portion, wherein the cylindrical portion is to be received within the blind hole, and flange forms the support surface such that the flange abuts the respective primary peripheral frame member about the blind hole.

The modular deck system can further comprise a plurality of deck panels that have a plurality of deck boards secured to at least two support members. Preferably, each deck panel has at least one a length or width that corresponds with the length or width of the base frames. More preferably, each deck panel has a length that is equal to the width of the base frames. Even more preferably, each deck panel has a width that that is equal to the half length of the base frames.

According to a second aspect of the present invention there is also provided a method of constructing a modular deck, the method comprising:

a. constructing a plurality of base frames, the construction of each base frame involving fastening four peripheral frame members together into a rectangular box, and securing one or more internal frame members within the box between opposing peripheral frame members;

b. securing a plurality of frame legs to each of the base frames to support the respective base frame above a ground surface;

c. fastening the plurality of base frames to one another; and d. securing deck material to the base frames.

Where the final deck level is to be continuous across two adjacent base frames, step (c) can involve:

c.i. fastening side surfaces of peripheral frame members of the adjacent base frames to one another.

Where the final deck level is to be stepped across two adjacent base frames, step (c) can involve:

c.ii. securing one of the peripheral frame member of an upper of the two adjacent base frames immediately above one of the peripheral frame member of a lower of the two adjacent base frames.

Preferably, step (c)(ii) further involves fastening at least one vertical connector to the outer surface of the peripheral frame member of the lower base frame, and fastening the at least one vertical connector to the internal surface of the peripheral frame member of the upper base frame.

In some embodiments, the length of each frame member is adjustable, and the method further involves:

e. adjusting the length of frame legs to level the base frames.

In some embodiments, the frame legs comprise:

a body that has an internally threaded hole;

a foot that has a ground contacting member, and an externally threaded shank that is received in the internally threaded hole such that the separation of the ground contacting member and the body is selectively adjustable; and a support surface that provides vertical support to the base frame to which respective frame leg is secured;

and step (b) the method further involves, for each frame leg:

b.i. locating the shank within the internally threaded hole;

b.ii. securing the frame leg relative to the respective base frame such that the base frame is supported by the support surface.

The plurality of frame legs can include first frame legs in which the body is elongate with the internally threaded hole formed at a first end of the body, and the frame leg further comprises a head that has a horizontal flange that forms the support surface;

and in the method:

step (b)(i) can further involve securing the head to the body; and step (b)(ii) can further involve securing the head to the base frame such that the horizontal flange provides vertical support to the base frame.

The head can further include one or more uprights that extend perpendicularly to the horizontal flange, and step (b)(ii) can further involve securing at least one of the uprights to the side surface of at least one of the peripheral frame members of the respective base frame.

The plurality of frame legs can alternatively or additionally include second frame legs in which the body has a cylindrical portion, and a flange formed at one end of the cylindrical portion, the flange forming the support surface; and at least some of the peripheral frame members have at least one blind hole that opens onto a bottom surface of respective peripheral frame member;

and in the method:

step (b)(ii) can further involve locating the cylindrical portion within the blind hole, such that the flange abuts the respective primary peripheral frame member about the blind hole.

The deck can include a plurality of deck panels that have a plurality of deck boards secured to at least two support members, and in the method step (d) can further involve securing the deck panels to the base frames The method can further involve:

f. installing cladding material to provide vertical surfaces that extend around peripheral edge(s) of the deck.

Step (f) can involve:

f.i. securing one or more droppers to base frame(s), the droppers extending from the base frames towards the ground surface; and f.ii. securing the cladding material to the droppers.

Alternatively or additionally step (f) can involve securing the cladding material to the frame legs and/or base frame.

The method can further involve:

g. installing support members on or in the ground surface immediately below the frame legs.

It will be understood that steps of the method do not necessarily have to occur in the order that is set out in this document. For example, step (g) is likely to be executed before step (a).

According to a third aspect of the present invention there is also provided a kit for a modular deck system, the kit including:

a modular deck system according to the first aspect, and instructions to perform the method of the second aspect.

BRIEF DESCRIPTION OF THE SEVERAL VIEWS OF THE DRAWINGS

In order that the invention may be more easily understood, embodiments will now be described, by way of example only, with reference to the accompanying drawings, in which.

DETAILED DESCRIPTION

Figure 1:
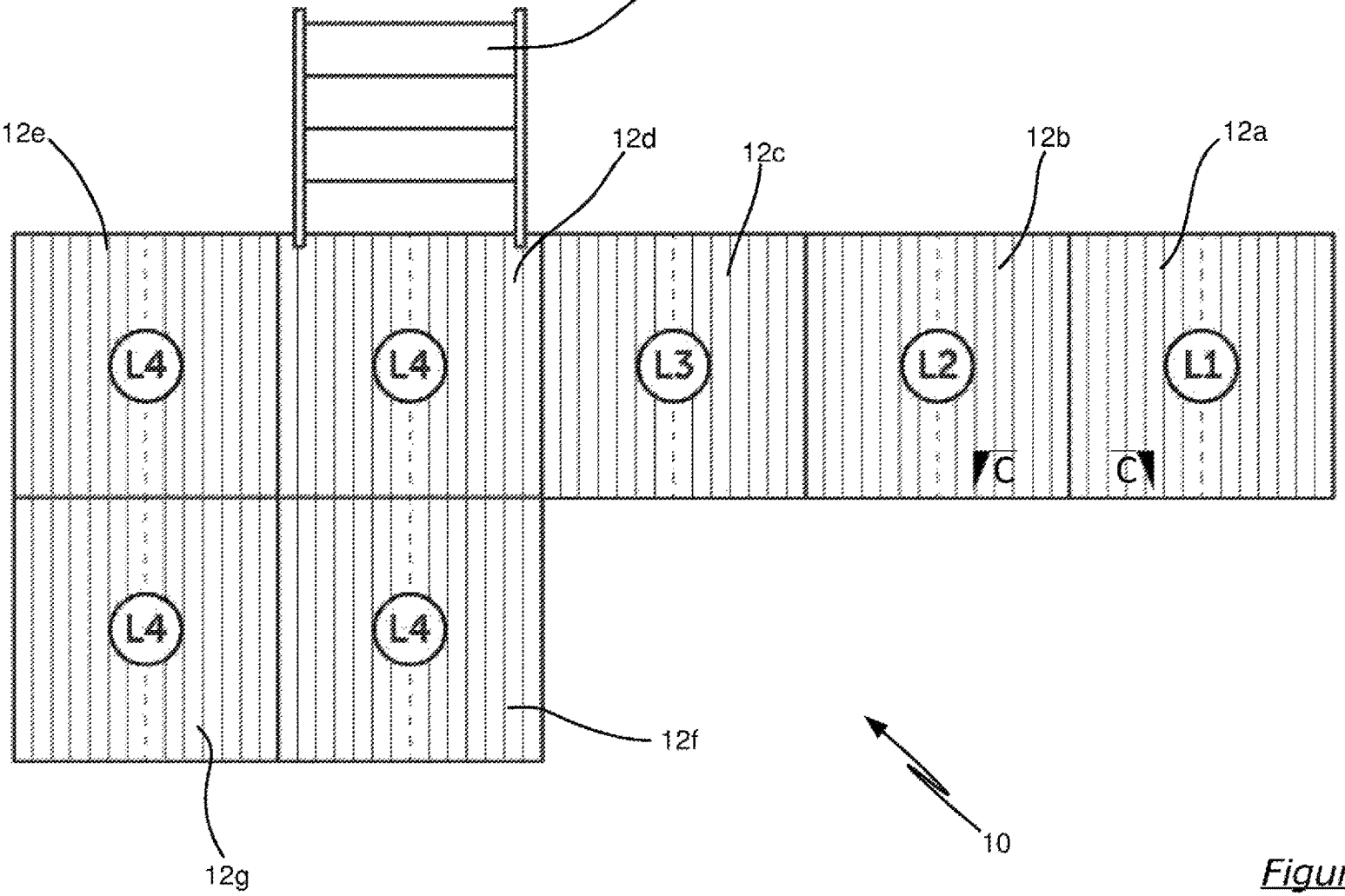
FIG. 1: is a plan view of a modular deck system according to a first embodiment of the present invention.
Figure 2:
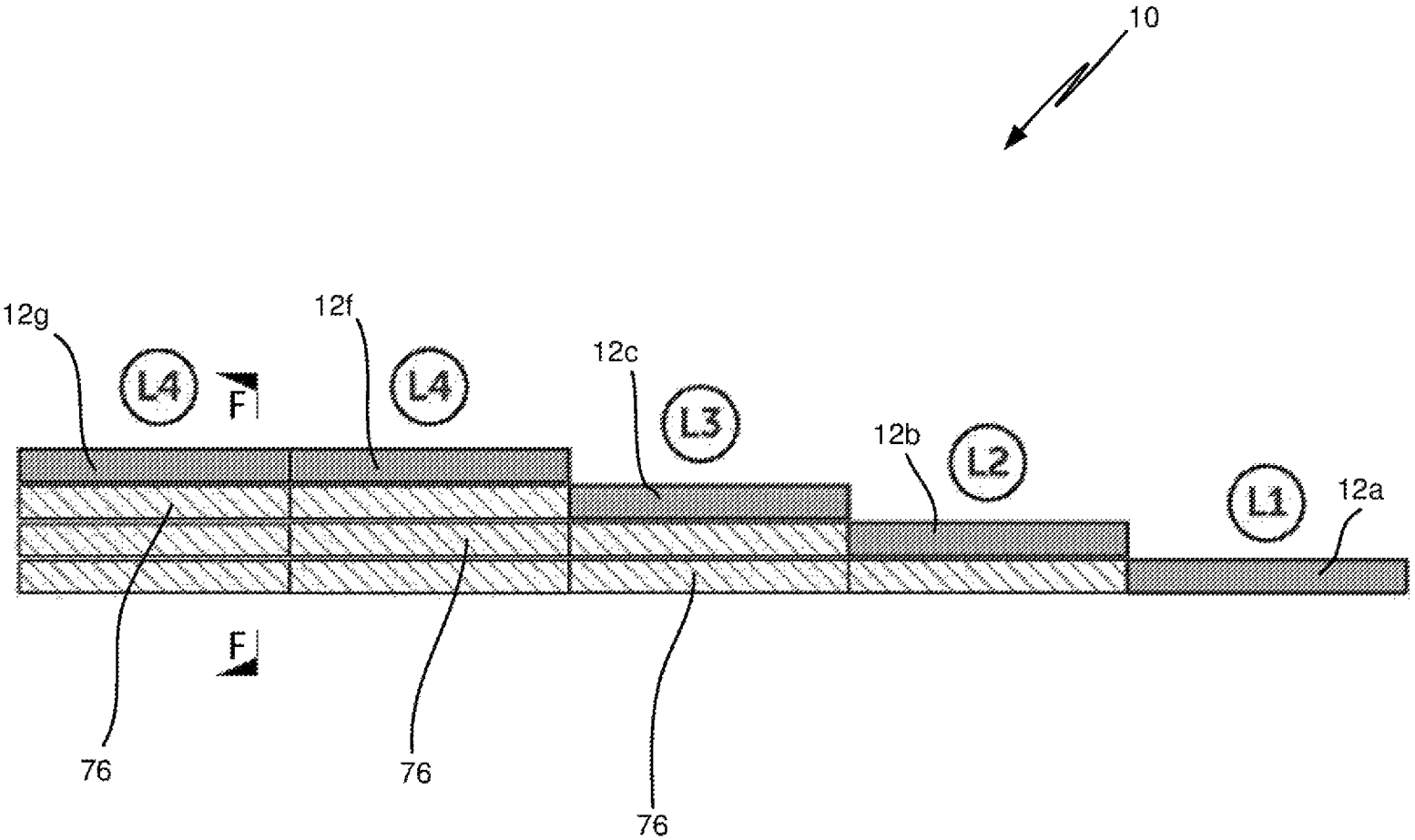
FIG. 2 is a side view of the deck system of FIG. 1, as viewed along the line IV-IV.

FIGS. 1 and 2 show a modular deck system 10 according to an embodiment of the present invention. The modular deck 10 of this example has seven deck modules that are arranged to form a deck with four distinct levels: a first deck module 12*a* at the first level L1, which is the lowest level in this particular deck 10; a second deck module 12*b* at a second level L2; a third deck module 12*c* at a third level L3; and four deck modules 12*d*, 12*e*, 12*f*, 12*g* at a fourth level L4. For convenience, the deck modules in the modular deck 10 are hereinafter referred to collectively as "deck modules 12". The deck module 10 illustrated in FIG. 1 includes an optional stair case S.

Figure 3:
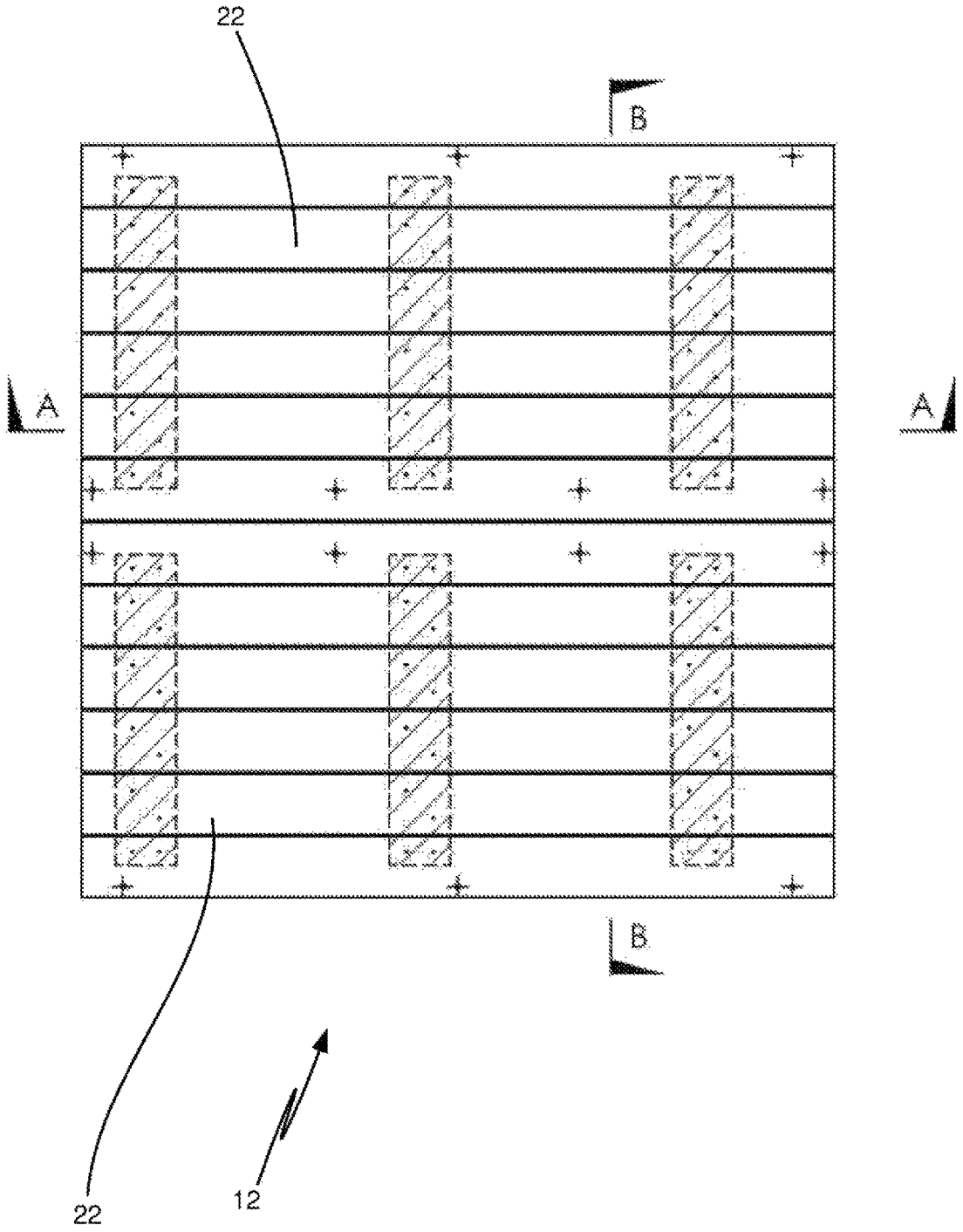
FIG. 3 is plan view of a deck module of the modular deck system of FIG. 1.
Figure 4:
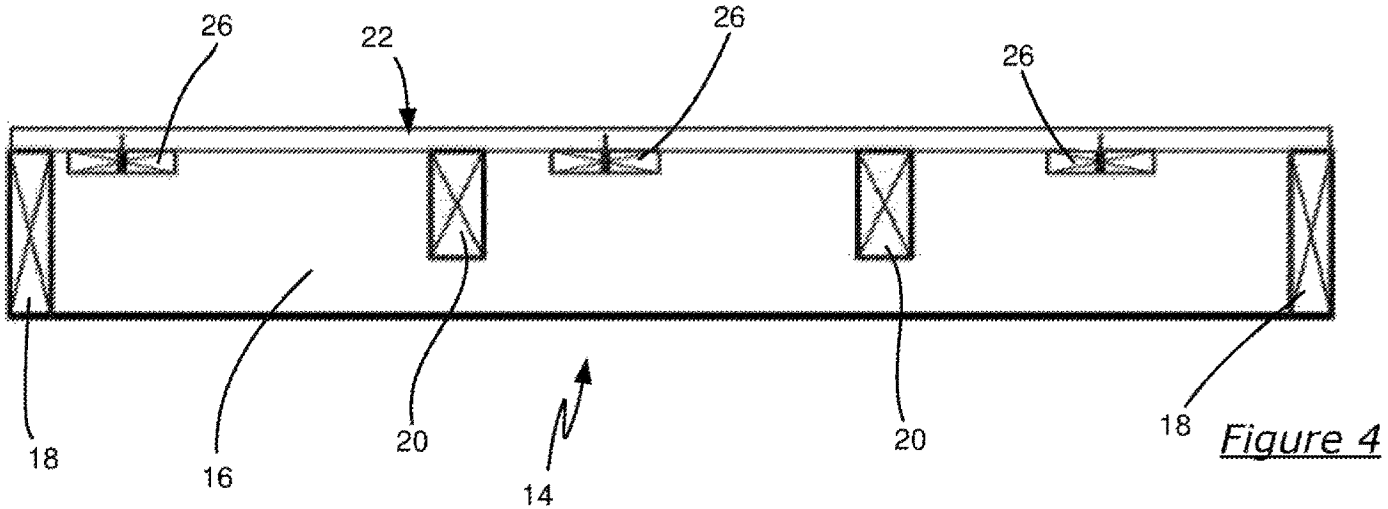
FIG. 4 is a section view of the deck module of FIG. 3, as viewed along the line A-A.
Figure 5:
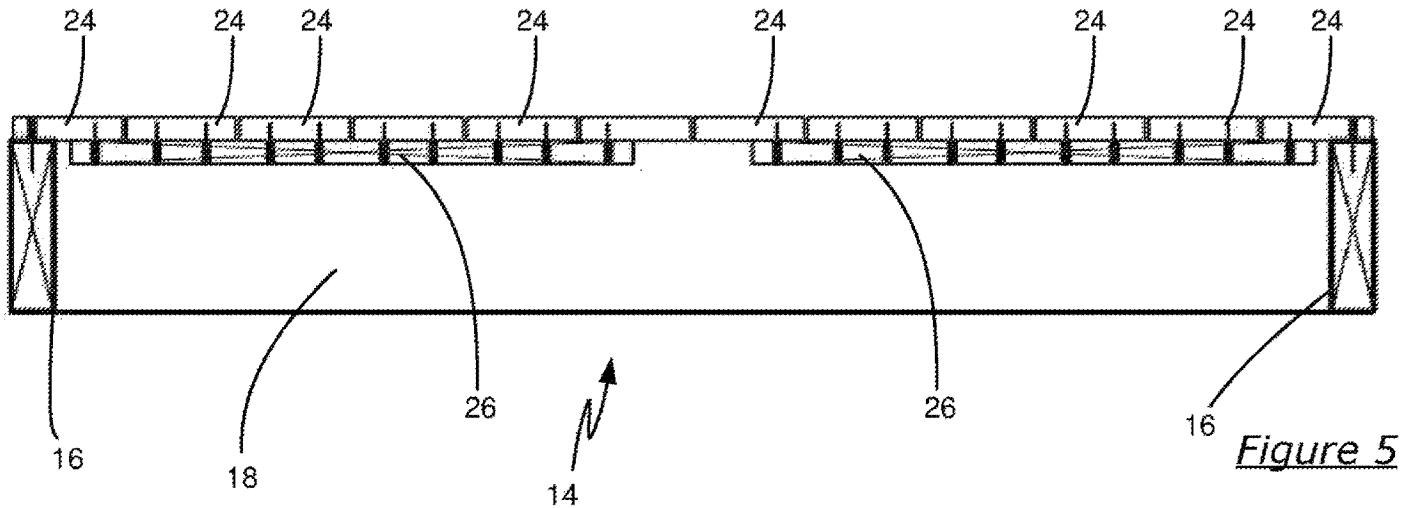
FIG. 5 is a section view of the deck module of FIG. 3, as viewed along the line B-B.

FIGS. 3 to 5 show a deck module 12 in further detail. Each deck module 12 includes a base frame 14 that has include four peripheral frame members that are to be fastened together into a rectangular box. In this particular embodiment, the base frame 14 has two primary peripheral frame members 16, and two secondary peripheral frame members 18. When the peripheral frame members 16, 18 are assembled into the rectangular box, end surfaces of the secondary peripheral frame members 18 are secured against side surfaces of the primary peripheral frame members 16.

In the embodiment shown in FIGS. 1 and 2, the primary peripheral frame members 16 are longer than the secondary peripheral frame members 18, such that each base frame forms a square box. Accordingly, each of the deck modules 12 is square and, as will be apparent from the description that follows, a variety of decks can be constructed using the deck modules 12 as units that are fastened together with various footprints and levels, as desired.

Figure 6:
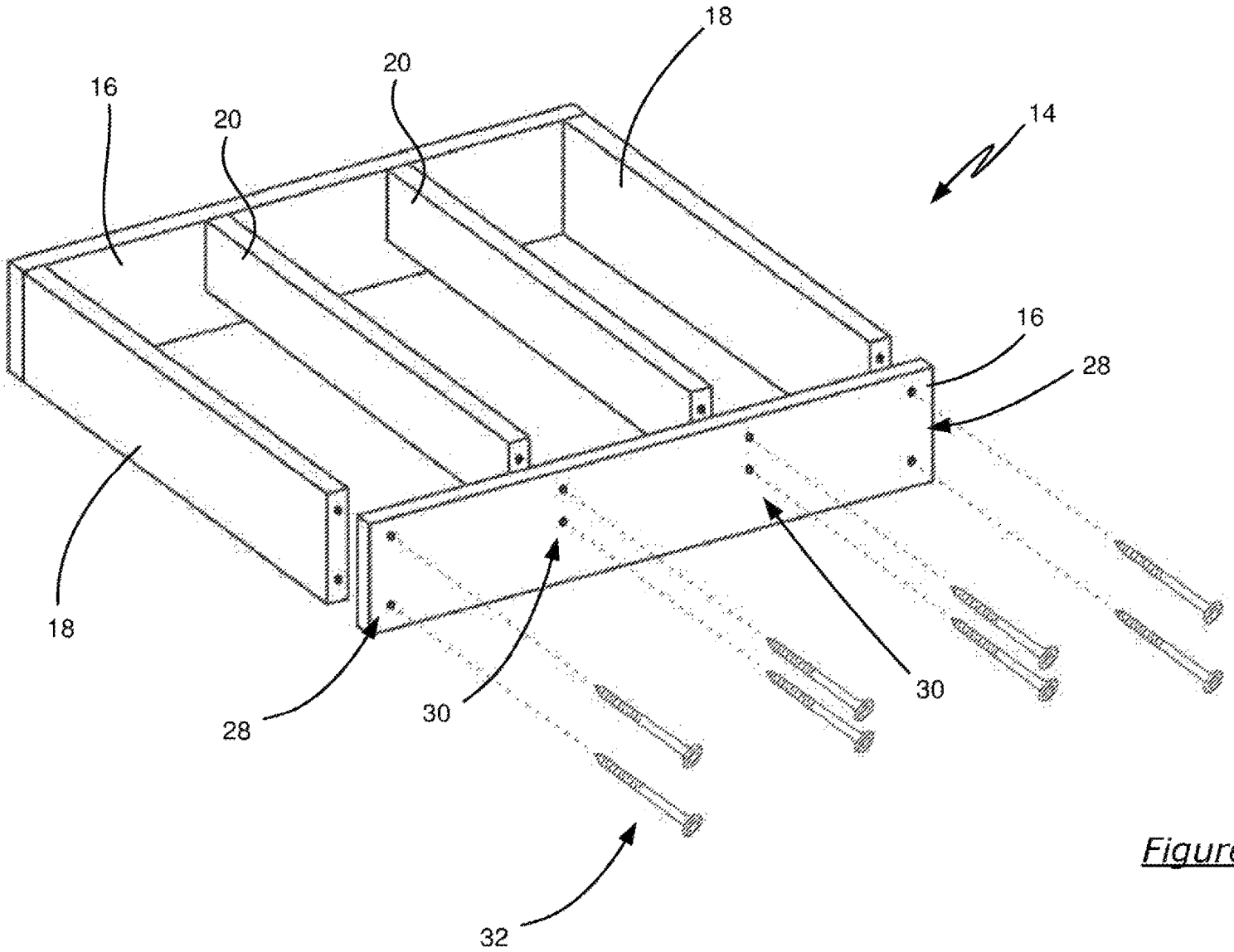
FIG. 6 is a perspective view of a partially assembled base frame of the deck module of FIG. 3.

The base frame 14 also includes two internal frame members 20 that, in the assembled deck module 12, are each secured within the box between opposing peripheral frame members 16. This arrangement is shown in FIG. 6.

In this particular embodiment, each deck module 12 includes deck panels 22, as shown in FIGS. 1, and 3 to 5. Each deck panel 22 includes deck boards 24 that are secured to support members 26. Further, in this particular embodiment, each deck panel 22 has six deck boards 24 and three support members 26. However, it will be appreciated that more or less deck boards and/or support members may be used, as desired.

The deck panels 22 of this embodiment have a length that is equal to the width of the base frames 14, and a width that that is equal to the half length of the base frames. Accordingly, each deck module 12 has two deck panels 22. Constructing a modular deck 10 with deck panels 22 has the benefit of significantly reducing the number of fasteners required to secure the deck boards to the support structure. In this particular embodiment, seven fasteners are required to secure each deck panel 22 to a respective base frame 14. In addition, the deck panel 22 can readily be sized (by geometric size and/or weight) to be lifted by a single person and carried in the rear luggage compartment of a sedan.

In some alternative embodiments, individual deck boards can be secured directly to the base frames 14.

As shown in FIG. 6, each of the primary peripheral frame members 16 has a first set of holes 28 pre-drilled in a direction perpendicular to a side surface to facilitate location of fasteners 32 to secure the primary peripheral frame members 16 to the secondary peripheral frame members 18. In addition, each of the primary peripheral frame members 16 has a second set of holes 30 that is pre-drilled through the respective frame member 16 in a direction perpendicular to a side surface to facilitate location of fasteners 32 to secure the internal frame members 20 to the primary peripheral frame members 16. Providing the primary peripheral frame members 16 with pre-drilled holes 28, 30 facilitates rapid construction of the deck 10.

In this particular embodiment, the dimensions of the frame members 16, 18, 20 are set out in Table 1. As is evident from FIG. 6, in this particular embodiment, the depth of the internal frame members 20 is less than that of the peripheral frame members 16, 18. Base frames 14 with frame members 16, 18, 20 of this geometry are beneficial in that the resulting modular deck 10 can satisfy both Australian domestic and commercial building regulations, including the relevant parts of Australian Standards: 1170.1, 1684.1, 1720, 2870, 3600, and 4100 (as at October 2012).

TABLE 1

| Frame member | Length (mm) | Depth (mm) | Thickness (mm) |
|---|---|---|---|
| Primary peripheral frame member 16 | 1113 | 140 | 35 |
| Secondary peripheral frame member 18 | 1043 | 140 | 35 |
| Internal frame member 20 | 1043 | 90 | 35 |

In one alternative embodiment, the dimensions of the frame members are set out in Table 2. A deck constructed with base frame members of this alternative can satisfy Australian domestic building regulations, but not the commercial building regulations.

TABLE 2

| Frame member | Length (mm) | Depth (mm) | Thickness (mm) |
|---|---|---|---|
| Primary peripheral frame member | 1113 | 90 | 45 |
| Secondary peripheral frame member | 1013 | 90 | 45 |
| Internal frame member | 1013 | 90 | 45 |

Figure 7:
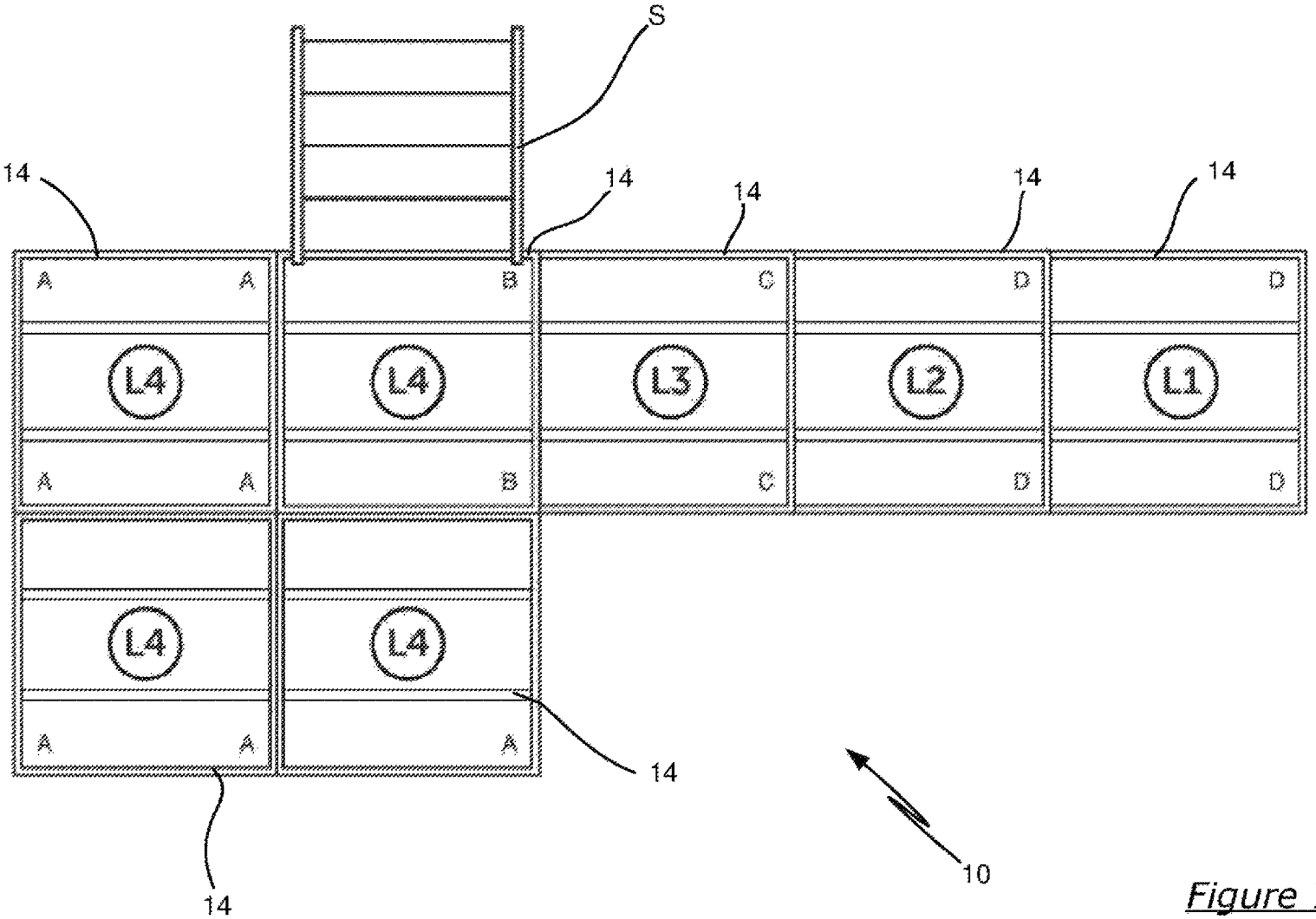
FIG. 7 is a plan view of the modular deck system of FIG. 1, with the deck panels omitted.
Figure 8:
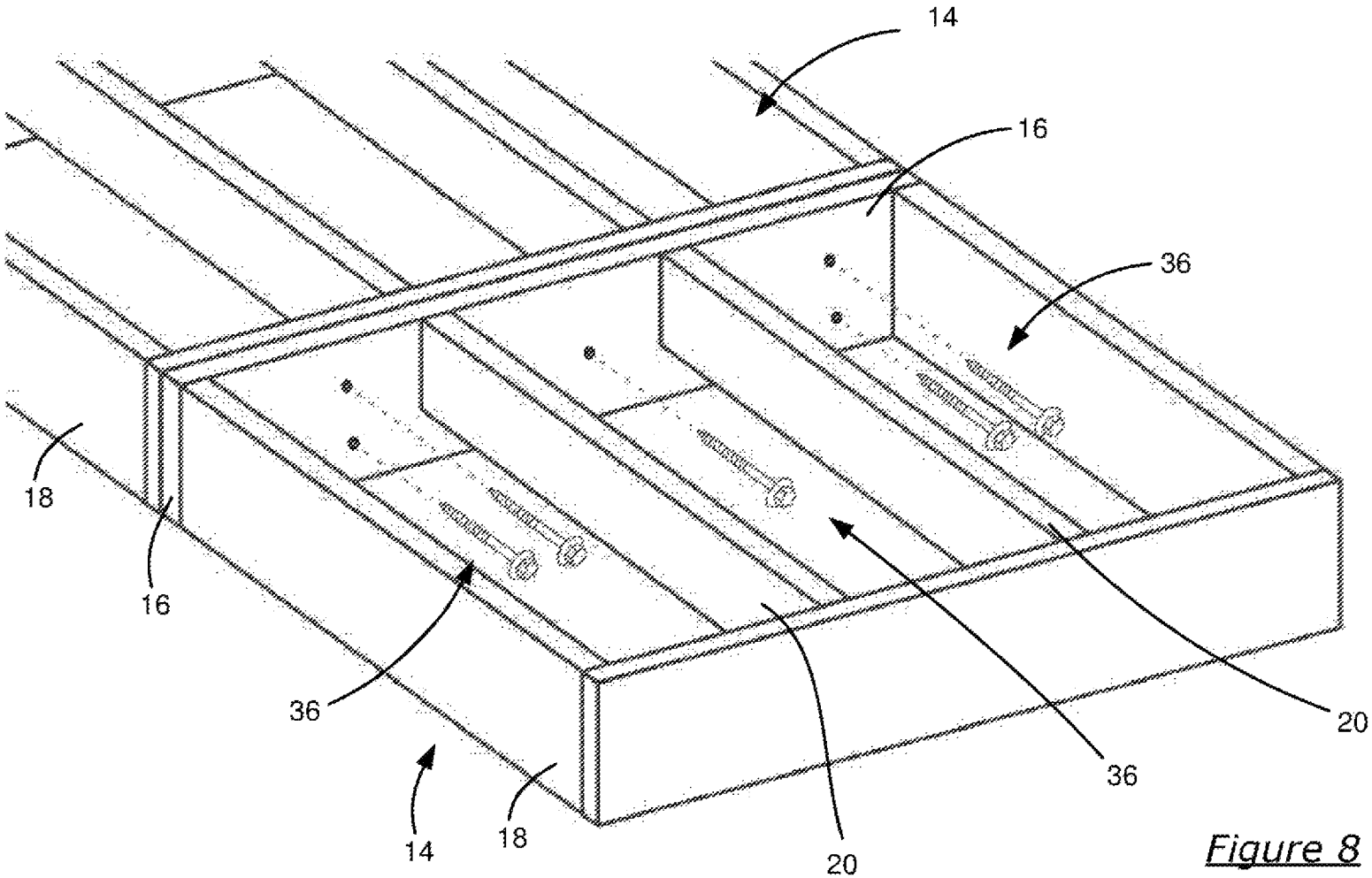
FIG. 8 is a perspective view of two base frames of the modular deck system as shown in FIG. 7.

FIG. 7 shows the modular deck 10 with the deck panels 22 omitted. As will be evident from this Figure, there are two distinct forms of connections of adjacent base frames 14 of the deck modules 12. The first form involves the connection of base frames 14 for the deck modules 12 with deck boards that are at a common level across the connection—in this example, the deck modules 12*d* to 12*g*, which are all on level L4. In other words, the final deck level is to be continuous across the two adjacent base frames. The first form of connection is illustrated in FIG. 8. The second form involves the connection of base frames 14 for the deck modules 12 with deck boards that are stepped across the connection—in this example, the deck modules 12*a* to 12*d*, which extend from levels L1 to L4. In other words, the final deck level is to be stepped across the two adjacent base frames. The second form of connection is illustrated in FIG. 9.

As shown in FIG. 8, two base frames 14 that are to be connected according to the first form have peripheral frame members 16 abutting and aligned side by side, and side surfaces of peripheral frame members 16 of the two adjacent base frames 14 are fastened to one another using fasteners 36.

Figure 9:
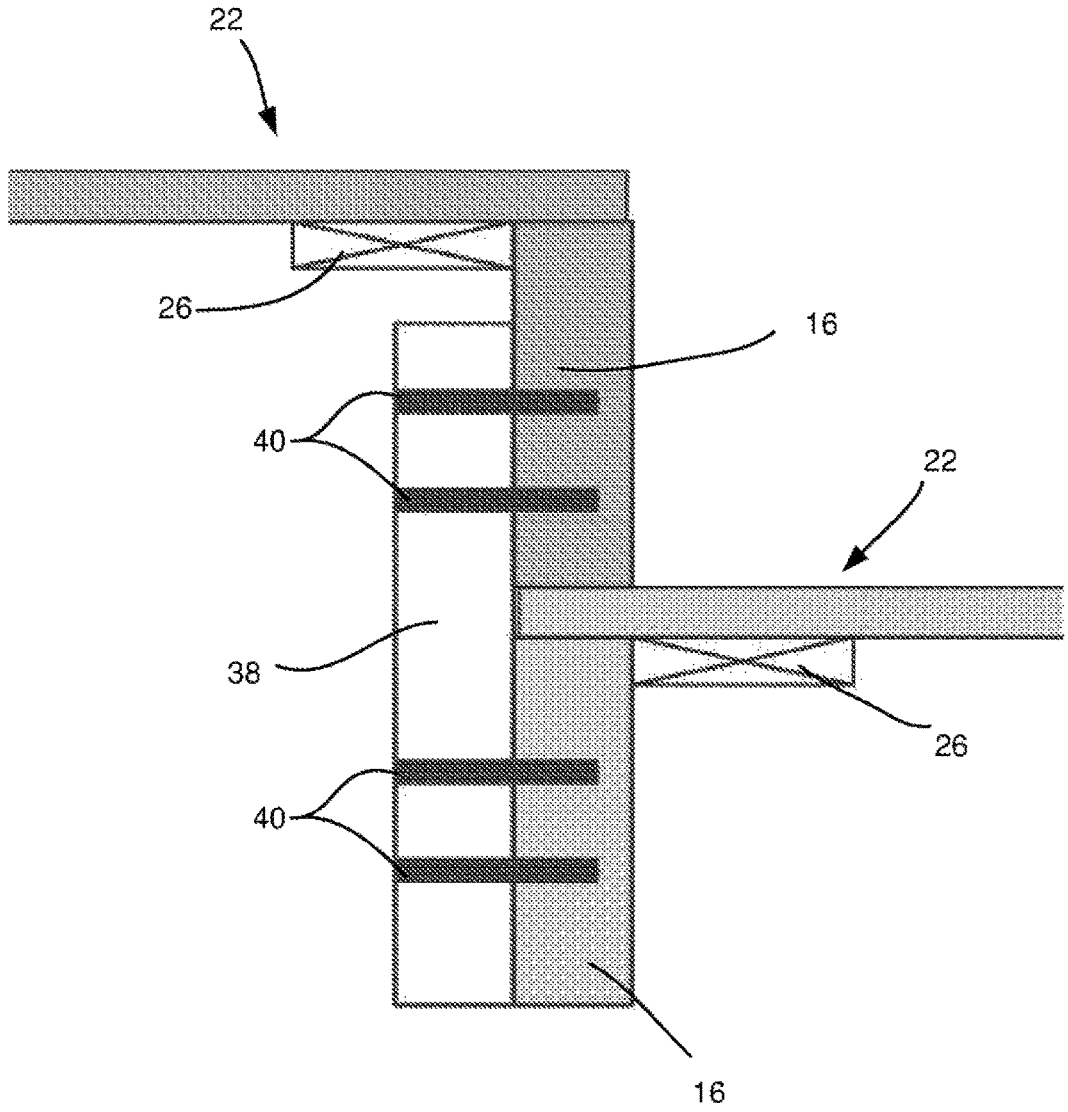
FIG. 9 is a vertical section view of the modular deck system of FIG. 1, as viewed along the line C-C.

As shown in FIG. 9, two base frames 14 that are to be connected according to the second form have the peripheral frame member 16 of the upper base frame 14 immediately above one of the peripheral frame member 16 of the lower base frame 14. One or more vertical connectors 38 are secured to both the outer surface of the peripheral frame member 16 of the lower base frame 14, and the internal surface of the peripheral frame member 16 of the upper base frame 14. Fasteners 40 secure the vertical connectors 38 to the base frames 14 to prevent relative movement, and transfer loads between the base frames 14 and the vertical connectors 38. As is shown in FIG. 9, in the second form of connection, a space is provided between the two adjacent base frames into which the deck boards 24 of the lower level extend.

Figure 11:
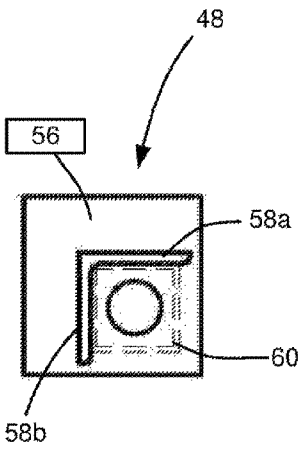
FIG. 11 is a top view of the first frame leg of FIG. 10.
Figure 10:
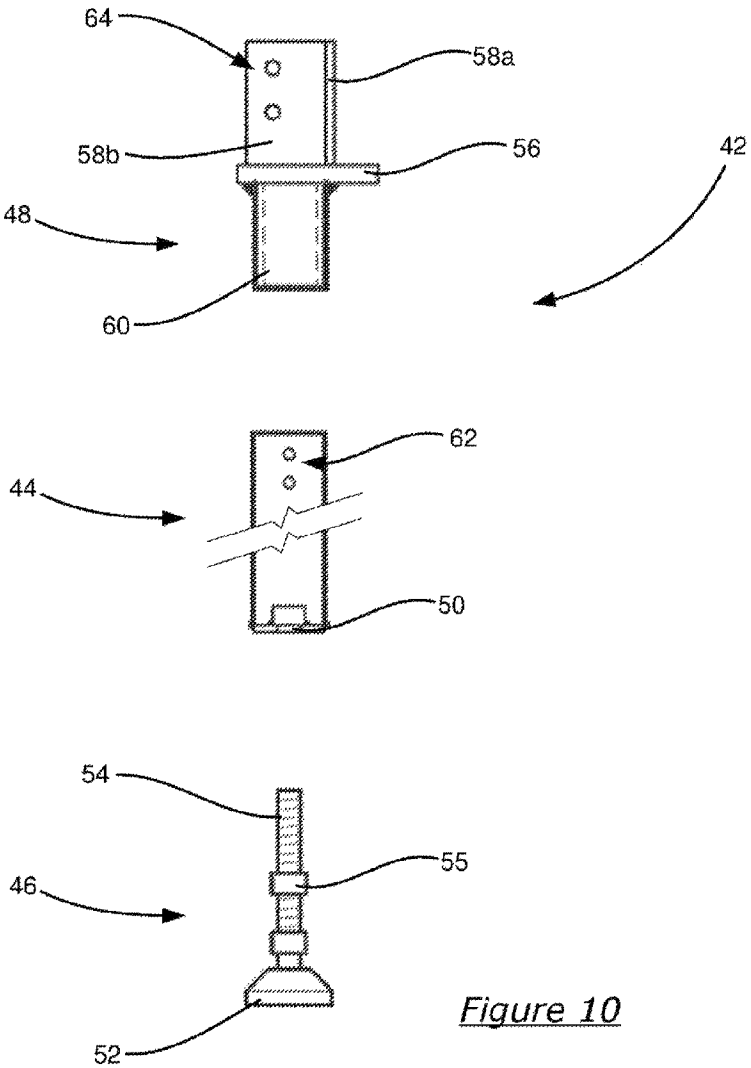
FIG. 10 is a side view of a first frame leg of the modular deck system of FIG. 1.

The modular deck system 10 further has frame legs that are each secured to one of the base frames 14 to support the respective deck module 12 above a ground surface. FIGS. 10 and 11 show a first frame leg 42, which has a body 44, a foot 46, and a support surface, which in this embodiment is provided on a head 48. The body 44 is in the form of an elongate tube with an internally threaded hole formed in a cap 50 at the lower end. The foot 46 has a ground contacting member 52, and an externally threaded shank 54 that is received in the internally threaded hole. By rotating the foot 46, the separation of the ground contacting member 52 and the body 44 is selectively adjustable. In this way, the length of the first frame leg 42 is adjustable to accommodate for height changes in the ground surface, such as cross fall and uneven gradient. A locking nut 55 can optionally be installed on the shank 54 between the ground contact member 52 and the body 44 to prevent unintended rotation of the foot 46.

The head 48 has a horizontal flange 56 that forms the support surface, and a pair of orthogonal uprights 58*a*, 58*b* that extend perpendicularly to the horizontal flange 56. On the opposite side of the horizontal flange 56 to the uprights 58 is a square tube 60, which is to be received within upper end of the body 44. The upper end of the body 44 has a pair of transverse holes 62 in which fasteners can be secured to retain the head 48 on the body 44. Further, each of the uprights 58 has a pair of holes 64 that are to be used for securing the head 48, and thus the first frame leg 42, to a base frame 14.

Figure 12:
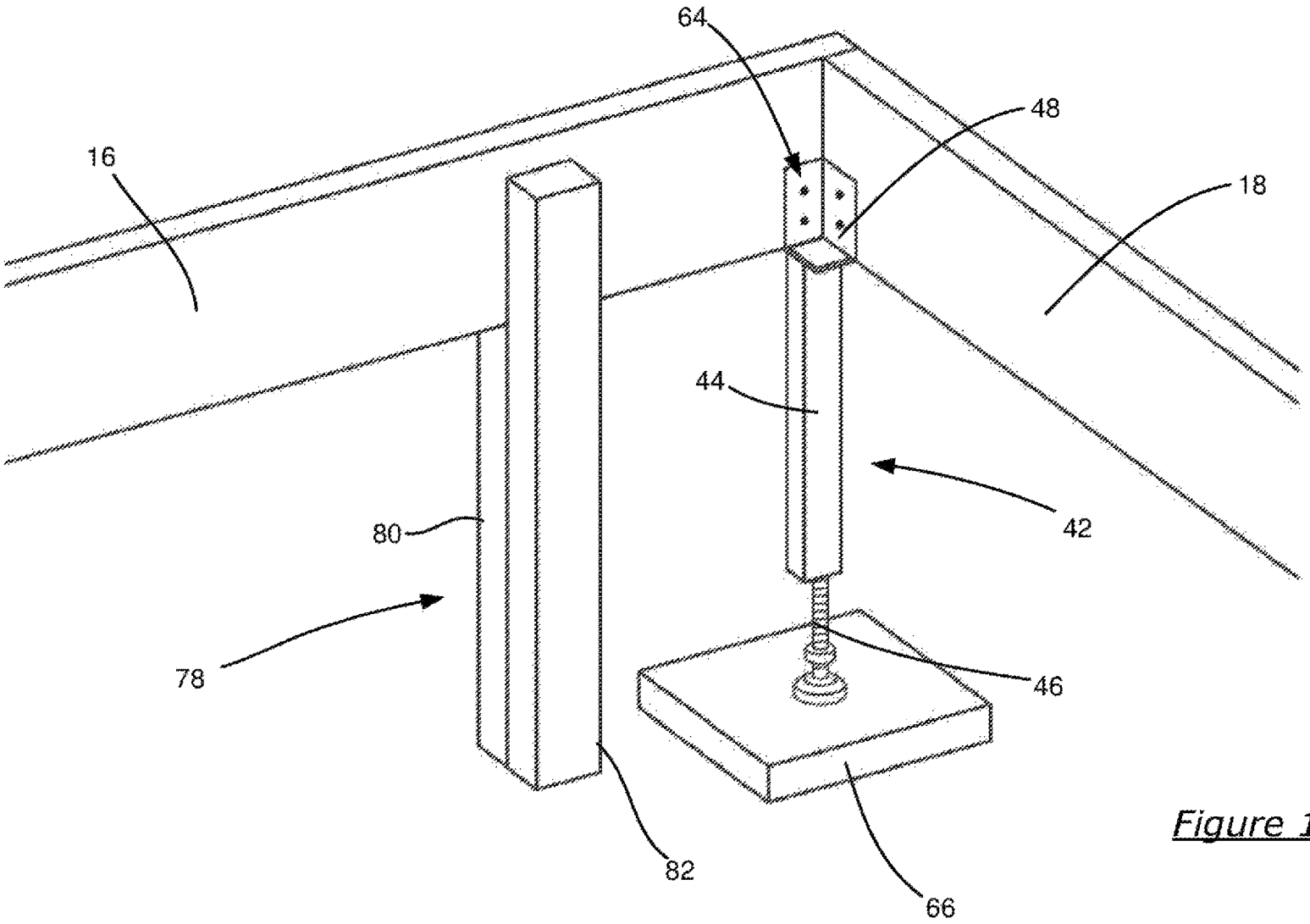
FIG. 12 is a perspective view of the first frame leg of FIG. 10, together with a portion of the base frame of FIG. 6.

FIG. 12 shows a portion of a base frame 14 that is supported above a ground surface by a first frame leg 42. In this example, the ground surface is in the form of a concrete pad 66. In FIG. 12, only a primary and secondary peripheral frame members 16, 18 are shown, and internal frame members 20 have been omitted. The uprights 58 of the head 48 are secured to adjacent internal surfaces of the primary and secondary peripheral frame members 16, 18.

The first frame legs 42 of the modular outdoor deck 10 can have a set of bodies 44 of different lengths. Accordingly, first frame legs 42 of a variety of lengths can be provided, such that base frames 14 can be supported at a variety of heights above the ground surface. In particular, four different lengths of bodies 44 can be provided.

Figure 13:
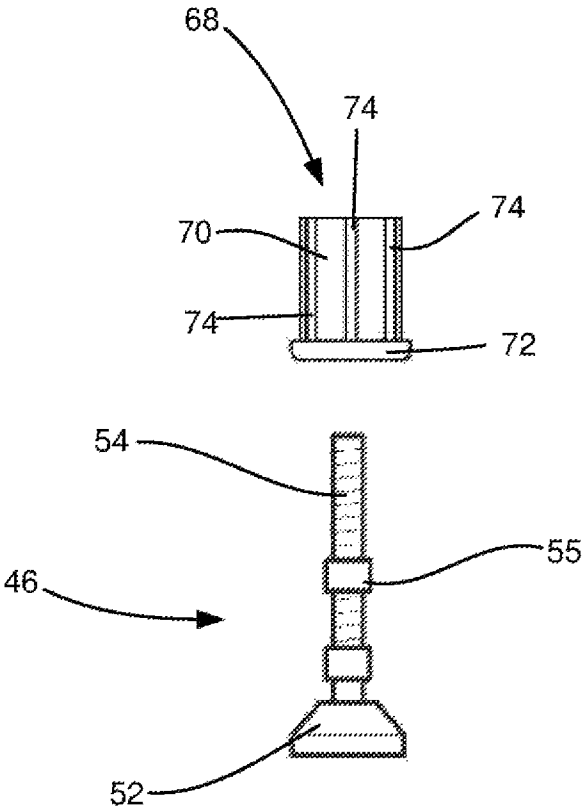
FIG. 13 is a side view of a second frame leg of the modular deck system of FIG. 1.

FIG. 13 shows a second frame leg 68, which has body in the form of a cylindrical portion 70, and a flange 72 formed at one end of the cylindrical portion 70. The flange 72 forms the support surface.

Each of the primary peripheral frame members 16 has a pair of blind holes (not shown) that opens onto a bottom surface. The cylindrical portion 70 is received within the blind hole of a peripheral frame member 16, with the flange abutting the primary peripheral frame member 16 about the blind hole. The cylindrical portion 70 also has an internally threaded hole formed in its lower end. A foot 46, as described previously with a ground contacting member 52 and an externally threaded shank 54, is connected to the cylindrical portion 70. Rotating the foot 46 adjusts the separation of the ground contacting member 52 and the cylindrical portion 70, and thus the height of the primary peripheral frame member 16 above the ground surface. In this way, the length of the second frame leg 68 is adjustable to accommodate for height changes in the ground surface. The cylindrical portion 70 has a series of longitudinal ribs 74 to prevent rotation of the cylindrical portion 70 within the peripheral frame member 16 when the foot 46 is rotated.

Figure 14:
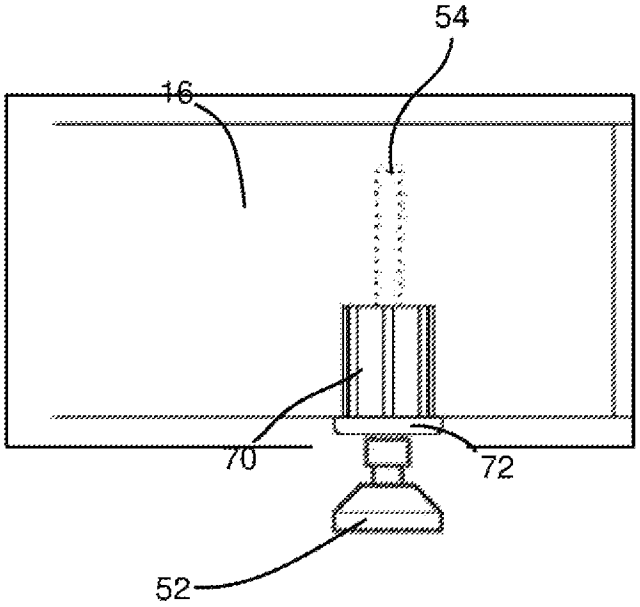
FIG. 14 is a schematic side view of the second frame leg of FIG. 13, together with a portion of the base frame of FIG. 6.

FIG. 14 is a schematic side view of a second frame leg 68 installed in a primary peripheral frame member 16.

In FIG. 7, the type and/or length of supporting frame leg is indicated by reference letters A, B, C, D. In this Figure:

At A: first frame legs 42 are used with long length bodies 44;

At B: first frame legs 42 are used with intermediate length bodies 44;

At C: first frame legs 42 are used with short length bodies 44; and

At D: second frame legs 68 are used.

Figure 15:
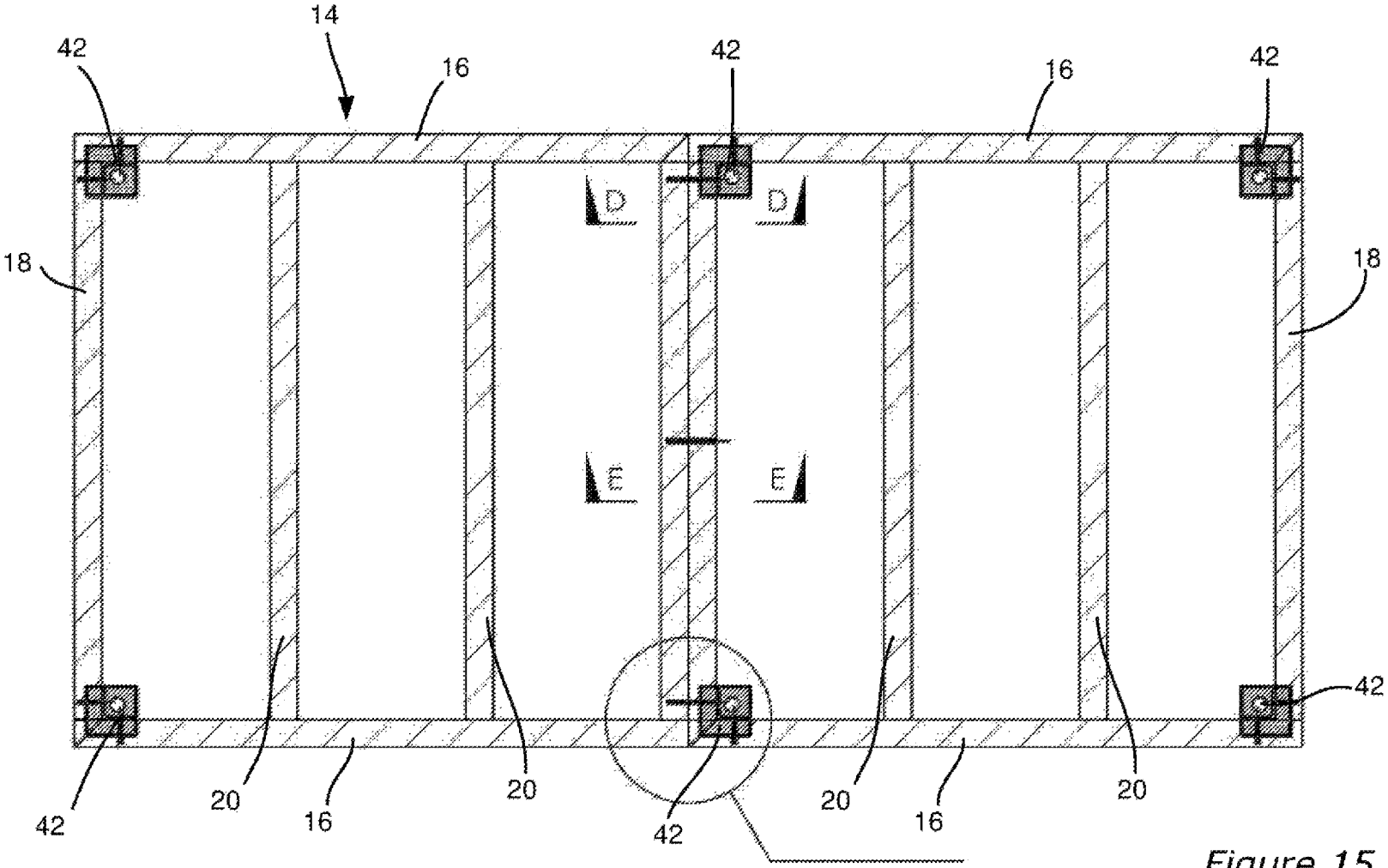
FIG. 15 is a plan view of two deck modules of the modular deck system of FIG. 1, supported by first frame legs of FIG. 8.
Figure 16:
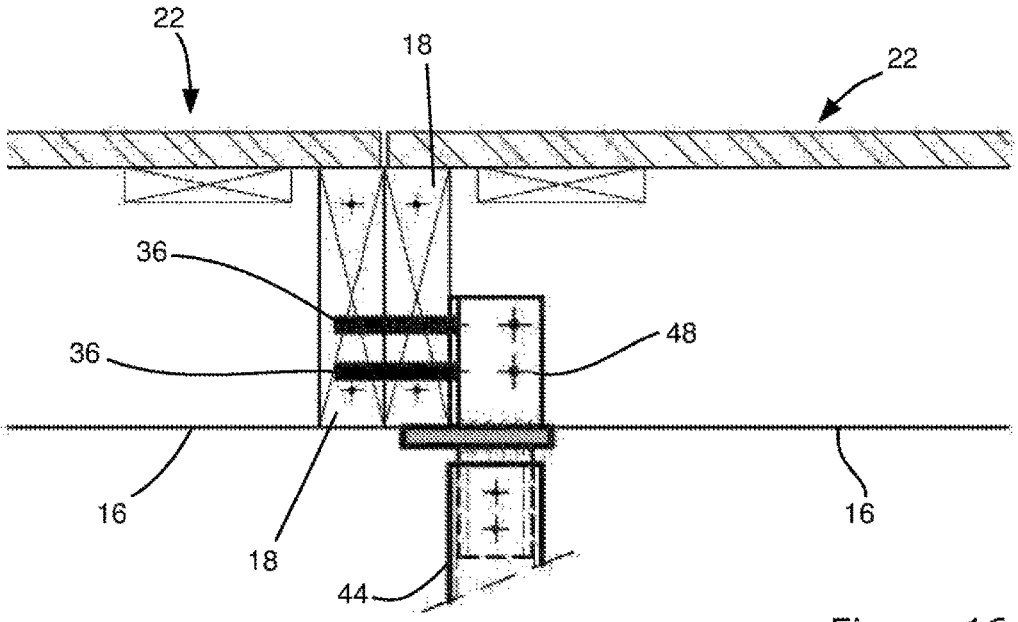
FIG. 16 is a section view of the two frame members of FIG. 15, as viewed along the line D-D.

FIG. 15 shows a plan view of two deck modules 12 of the modular deck system 10, with the deck panels omitted. The deck modules 12 are supported by six first frame legs 42. As shown in FIG. 16—which includes deck panels 22—fasteners 36 secure one of the uprights 58*a* to the secondary peripheral frame members 18, and also the abutting secondary periphery frame members 18 of the adjacent base frames 14 to one another.

Figure 17:
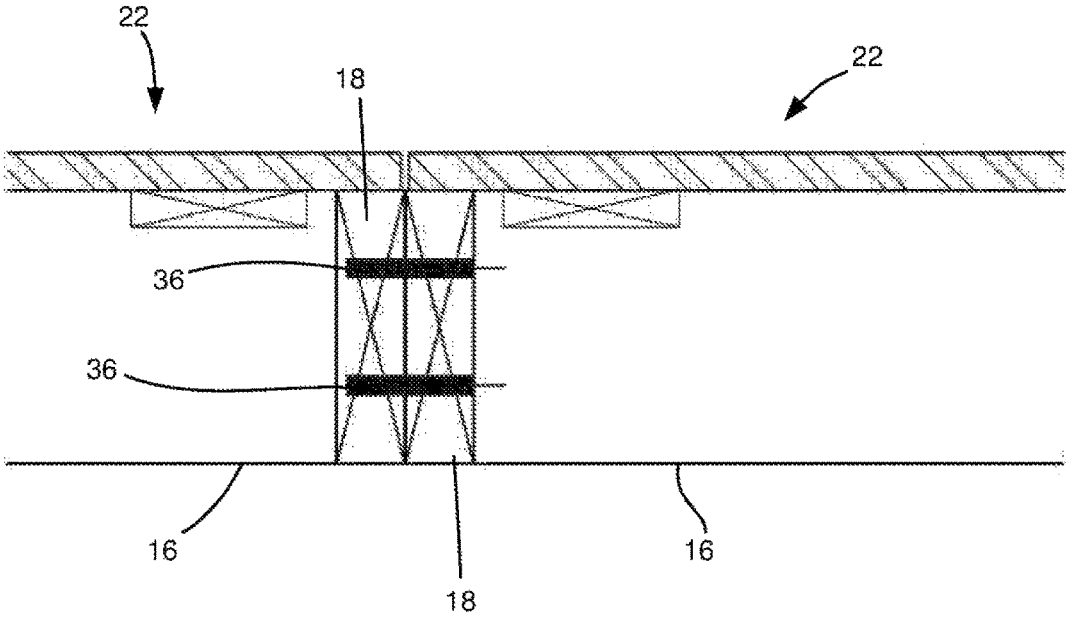
FIG. 17 is a section view of the two frame members of FIG. 16, as viewed along the line E-E.

As shown in FIG. 17—which also includes deck panels 22—fasteners 36 secure the abutting secondary periphery frame members 18 of the adjacent base frames 14 to one another, midway between the primary peripheral frame members.

Figure 18:
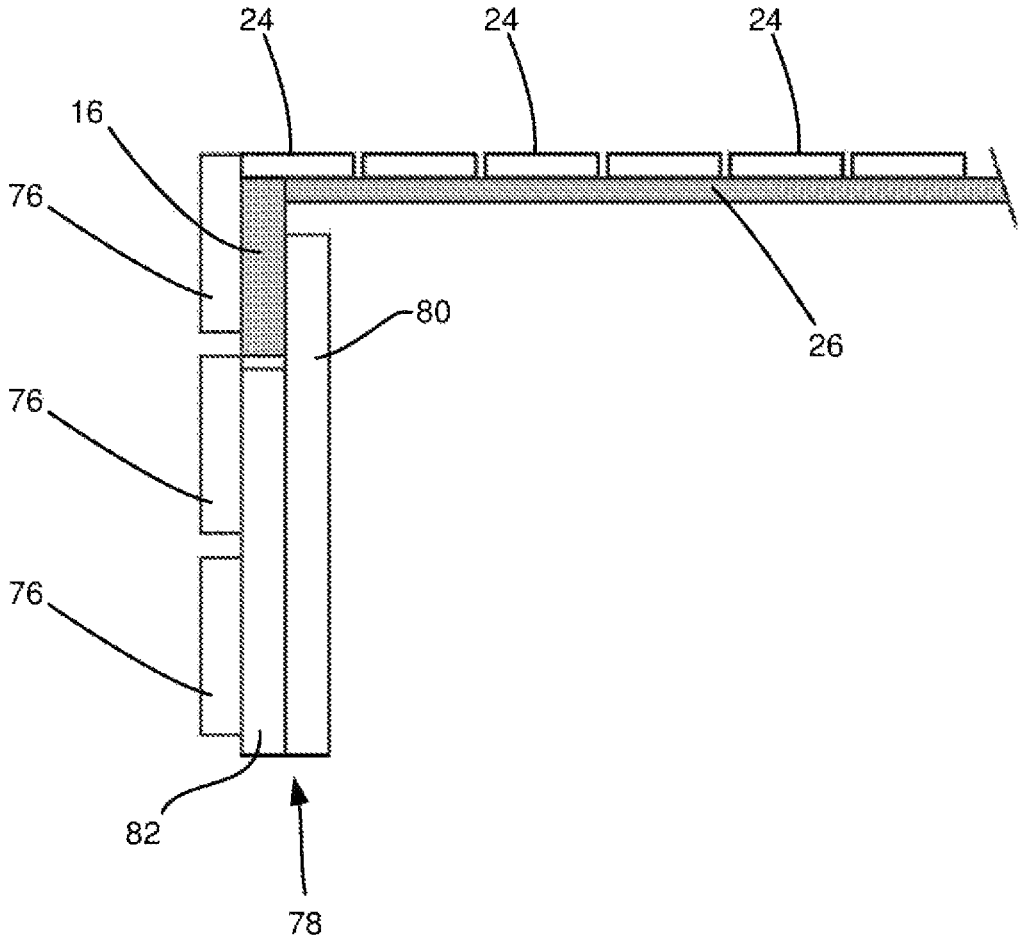
FIG. 18 is a vertical section view of the modular deck system of FIG. 2, as viewed along the line F-F.
Figure 19:
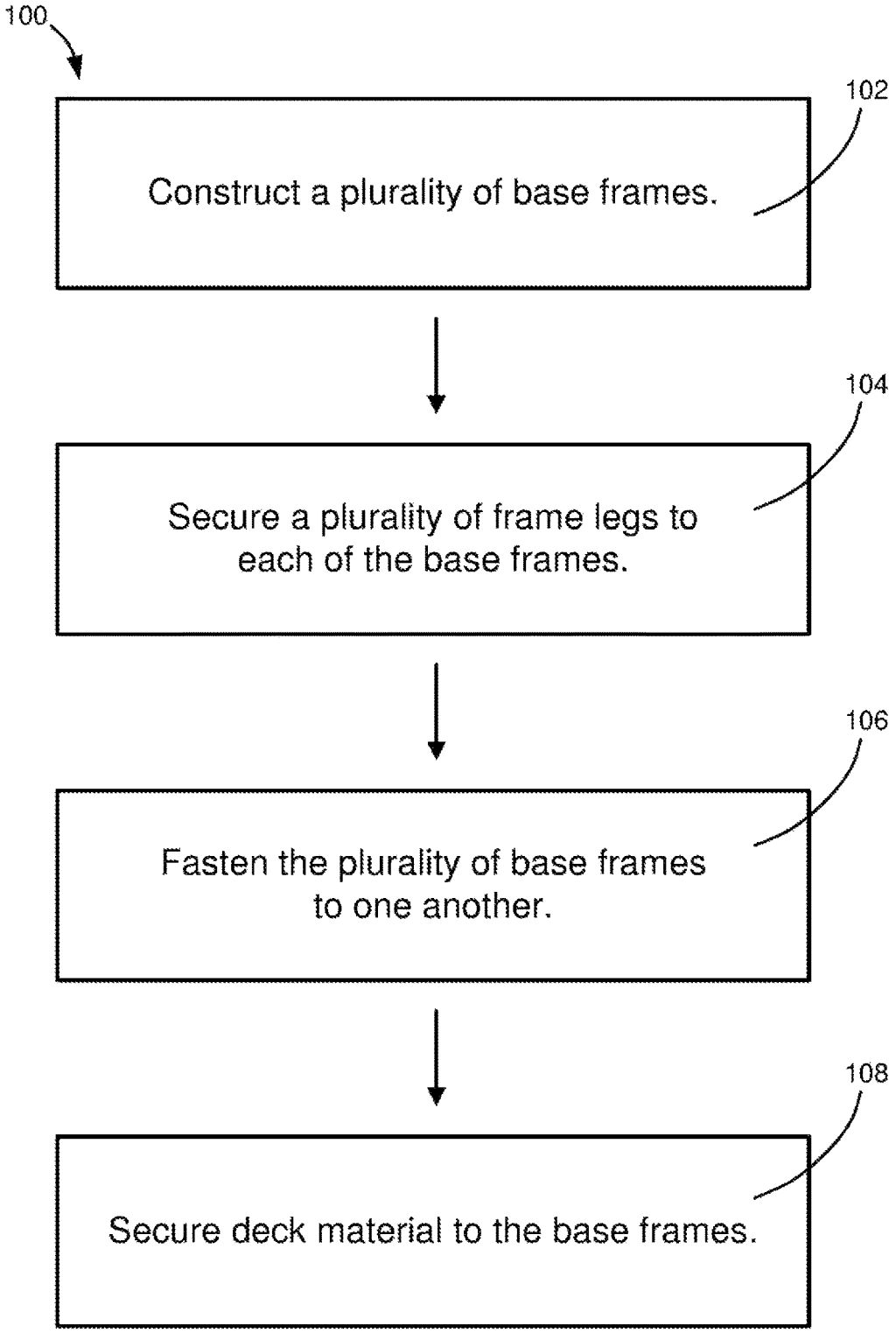
FIG. 19 is a schematic flow chart showing a method of constructing a modular deck, the method being in accordance with a second embodiment of the present invention.

FIG. 18 shows a vertical section of the modular deck system 10, as viewed along the line F-F of FIG. 2, in which the base frame 14 is supported at a height above the ground surface; for example, by a first frame leg (not shown). Cladding material, which in this embodiment is in the form of timber lengths 76, forms a vertical cladding that encloses the sides of the modular deck 10 beneath the base frames 14. As is evident from FIG. 2, the timber lengths 76 extend generally parallel to the top surface of the modular deck 10.

At appropriate locations, droppers 78 are secured to peripheral frame members 16, 18 of the base frame 14, and the timber lengths 76 are secured to droppers 78. The droppers 78 extend from the base frames 14 towards the ground surface, and the timber lengths 76 (or other cladding material) is secured to the droppers 78.

In this embodiment, each dropper 78 consists of an outer member 80 that has an outer face flush with the peripheral edge of the base frame 14 to which it is secured, and an inner member 82 that is secured to the base frame 14. The droppers 78 can be conveniently made from two lengths of timber that are fastened to one another, in a parallel fashion with the inner member 82 projecting upwardly beyond the upper end of the outer member 80. The inner member 82 is then to be secured to an internal face of the peripheral frame members 16, 18 of the respective base frame 14. The outer member 80 has a thickness that corresponds with that of the peripheral frame member 16, 18. The dropper 78 is also illustrated in FIG. 12.

Alternatively or additionally, the cladding material can be secured to peripheral frame members 16, 18 of the base frames 14, and/or to first frame legs 20.

As shown in FIG. 6, a method 100 for constructing a modular deck according to a second embodiment of the present invention includes the following steps:

a. constructing a plurality of base frames (step 102);

b. securing a plurality of frame legs to each of the base frames (step 104);

c. fastening the plurality of base frames to one another (step 106); and d. securing deck material to the base frames (step 108).

The construction of each base frame (step 102) involves fastening four peripheral frame members together into a rectangular box, and securing one or more internal frame members within the box between opposing peripheral frame members.

Following step 104, the frame legs can be placed on a ground surface, such that the respective base frame is supported above that ground surface.

In one embodiment, components of the modular deck system 10 are provided in a flat-pack for on-site installation, together with directions to construct a modular deck according to the method 100.

The various embodiments described above can be combined to provide further embodiments. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The claims defining the invention are as follows:

1. A modular deck system comprising:

a plurality of base frames that each include four peripheral frame members that are to be fastened together into a rectangular box, and one or more internal frame members that each are to be secured within the box between opposing peripheral frame members; and a plurality of frame legs that are each to be secured to one of the base frames to support the respective base frame above a ground surface, wherein the frame legs comprise:

a body that has an internally threaded hole;

a foot that has a ground contacting member, and an externally threaded shank that is received in the internally threaded hole such that the separation of the ground contacting member and the body is selectively adjustable; and a support surface that provides vertical support to the base frame to which a respective frame leg is secured;

wherein each of the primary peripheral frame members has at least one blind hole that opens onto a bottom surface of the primary peripheral frame member, and the plurality of frame legs include first frame legs in which the body has a cylindrical portion, and a flange formed at one end of the cylindrical portion, wherein the cylindrical portion is to be received within the blind hole, and the flange forms the support surface such that the flange abuts the respective primary peripheral frame member about the blind hole; and wherein the plurality of base frames are fastened to one another to provide a support structure on which to secure deck material.

2. A modular deck system according to claim 1, wherein the peripheral frame members are fastened together into the rectangular box, and the internal frame members are each secured within the box between opposing peripheral frame members to form a deck module; and the frame legs are each secured to one of the base frames to support the respective deck module above a ground surface;

wherein the base frames of the deck modules are fastened to one another to provide a support structure, and the modular deck system further comprises deck material that is secured to the support surface.

3. A modular deck system according to claim 1, wherein each base frame includes two primary peripheral frame members, and two secondary peripheral frame members, and wherein when the peripheral frame members are assembled into the rectangular box, end surfaces of the secondary peripheral frame members are secured against side surfaces of the primary peripheral frame members.

4. A modular deck system according to claim 3, wherein each of the primary peripheral frame members has a first set of holes pre-drilled in a direction perpendicular to a side surface to facilitate location of fasteners to secure the primary peripheral frame members to the secondary peripheral frame members.

5. A modular deck system according to claim 1, wherein each internal frame member extends between the two primary peripheral frame members, and each of the primary peripheral frame members has a second set of holes pre-drilled in a direction perpendicular to a side surface to facilitate location of fasteners to secure the internal frame members to the primary peripheral frame members.

6. A modular deck system according to claim 1, wherein the plurality of frame legs include second frame legs in which the body is elongate with the internally threaded hole formed at a first end of the body, and the frame leg further comprises a head that is to be secured to a second end of the body, the head having a horizontal flange that forms the support surface, and one or more uprights that extend perpendicularly to the horizontal flange wherein peripheral frame members are secured to the uprights.

7. A modular deck system according to claim 6, wherein the modular deck system includes at least two sets of frame leg bodies, the first set of frame leg bodies having a length that differs from the length of the bodies in the other set(s).

8. A modular deck system according to claim 1, further comprising a plurality of deck panels that have a plurality of deck boards secured to at least two support members.

9. A modular deck system according to claim 8, wherein each deck panel has at least one a length or width that corresponds with the length or width of the base frames.

10. A modular deck system according to claim 8, wherein each deck panel has a width that that is equal to the half length of the base frames.

11. A method of constructing a modular deck, the method comprising:

constructing a plurality of base frames, the construction of each base frame involving fastening four peripheral frame members together into a rectangular box, and securing one or more internal frame members within the box between opposing peripheral frame members;

securing a plurality of frame legs to each of the base frames to support the respective base frame above a ground surface;

fastening the plurality of base frames to one another; and securing deck material to the base frames such that the constructed modular deck includes:

the plurality of base frames that each include the four peripheral frame members fastened together into the rectangular box, and the one or more internal frame members that each are secured within the box between opposing peripheral frame members; and the plurality of frame legs that are each secured to one of the base frames to support the respective base frame above the ground surface, wherein the frame legs comprise:

a body that has an internally threaded hole;

a foot that has a ground contacting member, and an externally threaded shank that is received in the internally threaded hole such that the separation of the ground contacting member and the body is selectively adjustable; and a support surface that provides vertical support to the base frame to which a respective frame leg is secured;

wherein each of the primary peripheral frame members has at least one blind hole that opens onto a bottom surface of the primary peripheral frame member, and the plurality of frame legs include first frame legs in which the body has a cylindrical portion, and a flange formed at one end of the cylindrical portion, wherein the cylindrical portion is received within the blind hole, and the flange forms the support surface such that the flange abuts the respective primary peripheral frame member about the blind hole;

wherein the plurality of base frames are fastened to one another to provide a support structure on which the deck material is secured; and wherein the plurality of frame legs include second frame legs in which the body is elongate with the internally threaded hole formed at a first end of the body, and the frame leg further comprises a head that is secured to a second end of the body, the head having a horizontal flange that forms the support surface, and one or more uprights that extend perpendicularly to the horizontal flange wherein peripheral frame members are secured to the uprights.

12. A method according to claim 11, whereby where the final deck level is to be continuous across two adjacent base frames, fastening the plurality of base frames to one another further involves fastening side surfaces of peripheral frame members of the adjacent base frames to one another.

13. A method according to claim 11, whereby where the final deck level is to be stepped across two adjacent base frames, fastening the plurality of base frames to one another further involves securing one of the peripheral frame member of an upper of the two adjacent base frames immediately above one of the peripheral frame member of a lower of the two adjacent base frames.

14. A method according to claim 11, wherein the length of each frame leg is adjustable, and the method further involves:

adjusting the length of frame legs to level the base frames.

15. A method according to claim 11, wherein deck includes a plurality of deck panels that have a plurality of deck boards secured to at least two support members, and securing deck material to the base frames further involves securing the deck panels to the base frames.

16. A method according to claim 11, further involving:

installing cladding material to provide vertical surfaces that extend around peripheral edge(s) of the deck.

* * * * *